US008344906B2

(12) United States Patent
Emam et al.

(10) Patent No.: US 8,344,906 B2
(45) Date of Patent: Jan. 1, 2013

(54) AUTOMATED TRAFFIC SYNCHRONIZATION

(75) Inventors: Ossama Emam, Giza (EG); Peter G. Fairweather, Yorktown Heights, NY (US); Dimitri Kanevsky, Ossining, NY (US); Irina Rish, Rye Brook, NY (US)

(73) Assignee: International Business Machines Corporation, Armonk, NY (US)

( * ) Notice: Subject to any disclaimer, the term of this patent is extended or adjusted under 35 U.S.C. 154(b) by 948 days.

(21) Appl. No.: 12/206,507

(22) Filed: Sep. 8, 2008

(65) Prior Publication Data

US 2010/0060482 A1 Mar. 11, 2010

(51) Int. Cl.
*G08G 1/09* (2006.01)
*G06G 7/70* (2006.01)

(52) U.S. Cl. ..... 340/905; 701/117

(58) Field of Classification Search ..... 701/93, 701/96, 97, 98, 117; 340/436, 903–921
See application file for complete search history.

(56) References Cited

U.S. PATENT DOCUMENTS

| | | | | |
|---|---|---|---|---|
| 5,454,442 | A * | 10/1995 | Labuhn et al. | 180/169 |
| 5,777,451 | A * | 7/1998 | Kobayashi et al. | 318/587 |
| 5,969,640 | A * | 10/1999 | Timm et al. | 340/903 |
| 6,044,321 | A * | 3/2000 | Nakamura et al. | 701/96 |
| 6,246,948 | B1 * | 6/2001 | Thakker | 701/93 |
| 6,278,360 | B1 * | 8/2001 | Yanagi | 340/436 |
| 6,370,471 | B1 * | 4/2002 | Lohner et al. | 701/96 |
| 6,459,983 | B1 * | 10/2002 | Lichtenberg et al. | 701/96 |
| 6,516,262 | B2 | 2/2003 | Takenaga et al. | |
| 6,629,515 | B1 | 10/2003 | Yamamoto et al. | |
| 6,985,073 | B1 | 1/2006 | Doan | |
| 7,119,696 | B2 * | 10/2006 | Borugian | 340/576 |
| 7,138,923 | B2 * | 11/2006 | Ferrone et al. | 340/576 |
| 2003/0168271 | A1 * | 9/2003 | Massen | 180/167 |
| 2004/0068393 | A1 * | 4/2004 | Lawrence | 702/183 |
| 2004/0083049 | A1 | 4/2004 | Fuchs | |
| 2004/0260455 | A1 * | 12/2004 | Dort | 701/117 |
| 2006/0184312 | A1 | 8/2006 | Kiim | |
| 2007/0222638 | A1 | 9/2007 | Chen et al. | |

FOREIGN PATENT DOCUMENTS

| | | | |
|---|---|---|---|
| JP | 2006092129 | A | 4/2006 |
| JP | 2007219743 | A | 8/2007 |

* cited by examiner

*Primary Examiner* — Benjamin C Lee
*Assistant Examiner* — Sigmund Tang
(74) *Attorney, Agent, or Firm* — Lee Law, PLLC; Christopher B. Lee

(57) ABSTRACT

Spatial relationship information and performance information are determined for vehicles within a vehicular environment. Traffic signaling information is received from a traffic regulation system associated with the vehicular environment. At least one synchronized control action is calculated for each of the vehicles to synchronize the vehicles with the traffic regulation system based upon the traffic signaling information, the determined spatial relationship information, and the determined performance information for each of the vehicles. The associated at least one synchronized control action is communicated to each of the vehicles. This abstract is not to be considered limiting, since other embodiments may deviate from the features described in this abstract.

20 Claims, 4 Drawing Sheets

AUTOMATED TRAFFIC SYNCHRONIZATION

BACKGROUND OF THE INVENTION

1. Field of the Invention

The present invention relates to systems and methods for synchronizing vehicular traffic. More particularly, the present invention relates to automated traffic synchronization.

2. Related Art

Each driver of a vehicle controls his or her vehicle independently of other vehicles that are close to the vehicle. As events occur on a roadway, such as changes in traffic lights and roadway congestion, each driver also potentially has a different response time to those events and a different level of attention while driving. Accordingly, traffic patterns are random in nature. This random nature of traffic patterns causes "start-stop" or accordion-like traffic patterns on roadways at intersections and during heavy traffic situations. Collisions occur on roadways and are often attributed to carelessness and/or reckless driving.

BRIEF SUMMARY OF THE INVENTION

The subject matter described herein provides automated traffic synchronization, monitoring, and control to coordinate and improve vehicular traffic patterns, safety, fuel consumption, time efficiency, facility use, and other traffic-related aspects in a variety of vehicular environments. An automated traffic synchronization device determines spatial relationship information and performance information for vehicles. As a traffic regulation system changes traffic signaling information to indicate vehicle start times or stop times (e.g., yellow, red, or green light at a traffic light), the automated traffic synchronization device calculates at least one synchronized control action for each vehicle based upon the traffic signaling information, the spatial relationship information, and the performance information for each vehicle. The automated traffic synchronization device communicates the synchronized control action to each vehicle to indicate the appropriate action. This synchronized control action may be used to control vehicles that are equipped with automated acceleration and deceleration controls, a driver notification time, a vehicle start time, a vehicle stop time, or to provide an alert a driver to take the appropriate action when signaled. The automated traffic synchronization, monitoring, and control described is applicable to roadways with congested traffic, intersections with stop lights, waterways and canals, airports, train stations or switching yards, and other vehicular environments.

A method includes determining spatial relationship information and performance information for each of a plurality of vehicles within a vehicular environment; receiving traffic signaling information from a traffic regulation system associated with the vehicular environment; calculating at least one synchronized control action for each of the plurality of vehicles to synchronize the plurality of vehicles with the traffic regulation system based upon the traffic signaling information, the determined spatial relationship information, and the determined performance information for each of the plurality of vehicles; and communicating the associated at least one synchronized control action to each of the plurality of vehicles.

A system includes a memory adapted to store traffic synchronizing information; and a processor programmed to determine spatial relationship information and performance information for each of a plurality of vehicles within a vehicular environment; store the spatial relationship information and the performance information to the memory; receive traffic signaling information from a traffic regulation system associated with the vehicular environment; store the traffic signaling information to the memory; calculate at least one synchronized control action for each of the plurality of vehicles to synchronize the plurality of vehicles with the traffic regulation system based upon the traffic signaling information, the determined spatial relationship information, and the determined performance information for each of the plurality of vehicles; and communicate the associated at least one synchronized control action to each of the plurality of vehicles.

An alternative system includes a memory adapted to store traffic synchronizing information; and a processor programmed to determine spatial relationship information and performance information for each of a plurality of vehicles within a vehicular environment; store the spatial relationship information and the performance information to the memory; receive traffic signaling information from a traffic regulation system associated with the vehicular environment; store the traffic signaling information to the memory; receive driver status information for a driver of at least one of the plurality of vehicles from a driver monitoring module associated with the at least one of the plurality of vehicles, the driver status information comprising at least one of driver body orientation information, driver head orientation information, driver eye direction information, and driver activity information; store the driver status information to the memory; calculate at least one synchronized control action for each of the plurality of vehicles to synchronize the plurality of vehicles with the traffic regulation system based upon the traffic signaling information, the determined spatial relationship information and performance information for each of the plurality of vehicles, and the driver status information, where the at least one synchronized control action comprises at least one of an acceleration parameter, a deceleration parameter, a driver notification time, a vehicle start time, and a vehicle stop time for each of the plurality of vehicles; and communicate the associated at least one synchronized control action to each of the plurality of vehicles.

Those skilled in the art will appreciate the scope of the present invention and realize additional aspects thereof after reading the following detailed description of the preferred embodiments in association with the accompanying drawing figures.

BRIEF DESCRIPTION OF THE SEVERAL VIEWS OF THE DRAWINGS

The accompanying drawing figures incorporated in and forming a part of this specification illustrate several aspects of the invention, and together with the description serve to explain the principles of the invention.

DETAILED DESCRIPTION OF THE INVENTION

Figure 1:
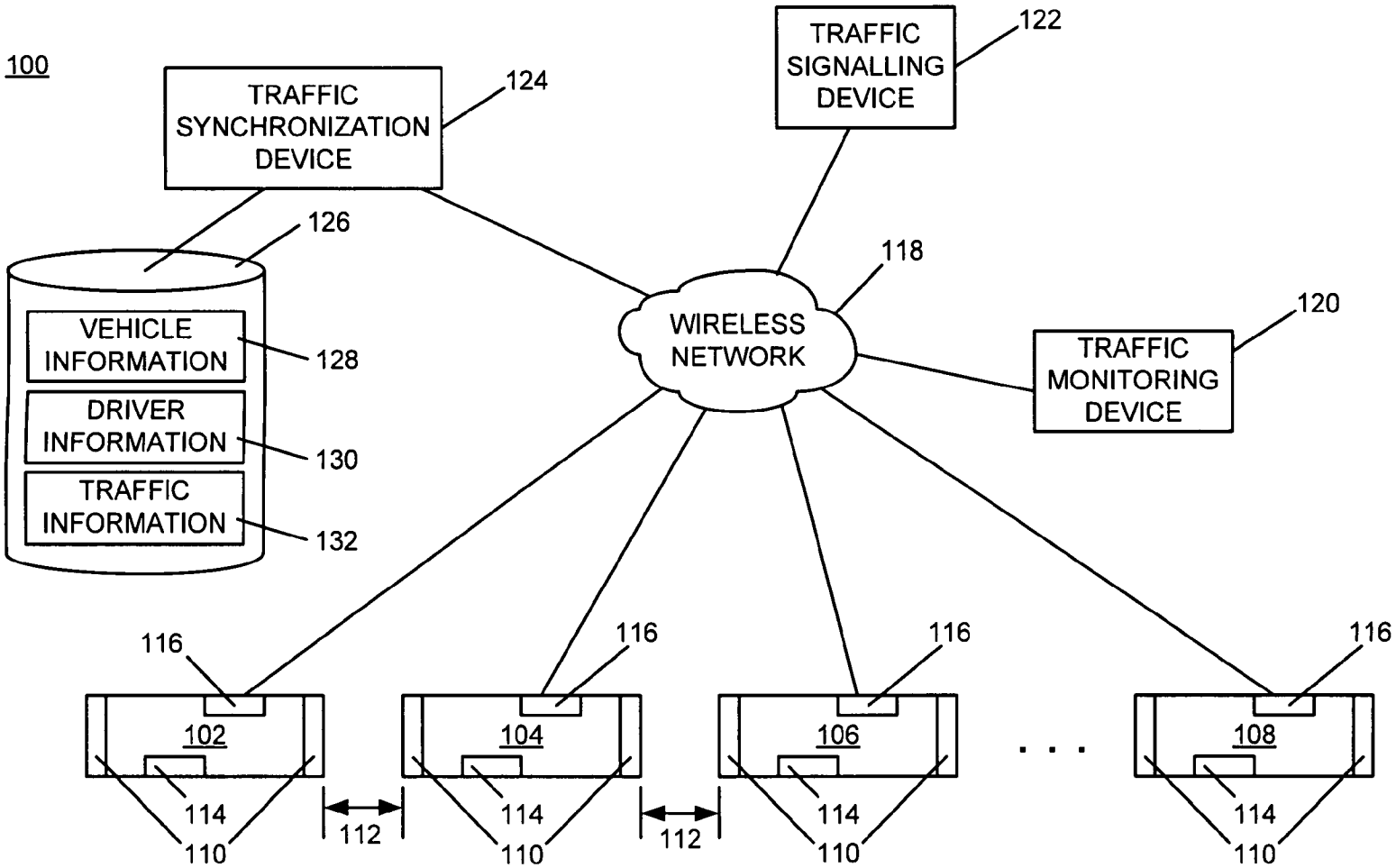
FIG. 1 is a block diagram of an example of an implementation of a system for automated traffic synchronization, monitoring, and control according to an embodiment of the present subject matter.

The examples set forth below represent the necessary information to enable those skilled in the art to practice the invention and illustrate the best mode of practicing the invention. Upon reading the following description in light of the accompanying drawing figures, those skilled in the art will understand the concepts of the invention and will recognize applications of these concepts not particularly addressed herein. It should be understood that these concepts and applications fall within the scope of the disclosure and the accompanying claims.

The subject matter described herein provides automated traffic synchronization, monitoring, and control to coordinate and improve vehicular traffic patterns, safety, fuel consumption, time efficiency, facility use, and other traffic-related aspects in a variety of vehicular environments. An automated traffic synchronization device determines spatial relationship information and performance information for vehicles. As a traffic regulation system changes traffic signaling information to indicate vehicle start times or stop times (e.g., yellow, red, or green light at a traffic light), the automated traffic synchronization device calculates at least one synchronized control action for each vehicle based upon the traffic signaling information, the spatial relationship information, and the performance information for each vehicle. The automated traffic synchronization device communicates the synchronized control action to each vehicle to indicate the appropriate action. This synchronized control action may be used to control vehicles that are equipped with automated acceleration and deceleration controls, a driver notification time, a vehicle start time, a vehicle stop time, or to provide an alert a driver to take the appropriate action when signaled. The automated traffic synchronization, monitoring, and control described is applicable to roadways with congested traffic, intersections with stop lights, waterways and canals, airports, train stations or switching yards, and other vehicular environments. Additionally, the present subject matter may be used to compensate for foggy conditions, stormy conditions, snow (e.g., blizzard) conditions, and other conditions that increase danger within vehicular environments. The automated traffic synchronization, monitoring, and control of the present subject matter may be used to increase traveling distances between vehicles, decrease vehicle speeds, and to perform other compensations automatically to potentially improve safety for vehicles traveling under these conditions.

The automated traffic synchronization, monitoring, and control described herein may be performed in real time to allow prompt response and control of multiple vehicles within a vehicular environment. For purposes of the present description, real time shall include any time frame of sufficiently short duration as to provide reasonable response time for information processing acceptable to a user of the subject matter described. Additionally, the term "real time" shall include what is commonly termed "near real time"—generally meaning any time frame of sufficiently short duration as to provide reasonable response time for on demand information processing acceptable to a user of the subject matter described (e.g., within a few seconds or less than ten seconds or so in certain systems). These terms, while difficult to precisely define are well understood by those skilled in the art.

To further elaborate on the problems that the present subject matter addresses, it may be helpful to consider a traffic environment on a roadway. "Start-stop" effects occur on roadways due to random response times of drivers to signaling and other events that occur on the roadways. These random response times are compounded when an inattentive driver does not realize that it is time to move from a stopped position or does not realize that the traffic ahead is stopping. Additionally, a driver may not even be able to see a traffic light and may only know when to begin moving based upon the vehicle in front of the driver's vehicle beginning to move. Certain drivers also tend to slow to look at traffic wrecks and then increase in speed after passing the wreck. Accordingly, a time lag is introduced at each vehicle and is compounded repeatedly as each successive driver responds to traffic events and situations. This activity creates an accordion-like situation in the traffic flow. The present subject matter addresses these issues.

FIG. 1 is a block diagram of an example of an implementation of a system 100 for automated traffic synchronization, monitoring, and control. Within the system 100 are a vehicle 102, a vehicle 104, a vehicle 106, up to a vehicle 108. For purposes of the present description, the vehicle 102 through the vehicle 108 may be considered to be any number of vehicles.

The vehicles 102 through 108 may be automobiles, motorcycles, planes, boats, trains, or other vehicles, and the system 100 may be used in an appropriate vehicular environment for the respective vehicle type. As such, the system 100 may be used within a roadway environment, an airport taxi way or runway environment, a waterway environment (e.g., canal or shipping lane), and a train station or switching yard without departure from the scope of the present subject matter. Additionally, the present subject matter may be usable to assist with multi-vehicular type environments, such as with emergency landings on roadways for planes that are in distress and at boat ramps where automobiles with trailers are sequenced to unload and load boats. Accordingly, all possible combinations of vehicles and vehicle environments are considered within the scope of the present subject matter.

Each of the vehicles 102 through 108 is equipped with at least one of vehicle relative-position sensor 110 located so as to provide sensing capabilities for a front and rear of each respective vehicle to determine a distance 112 between each pair of vehicles 102 through 108. The vehicle relative-position sensors 110 may include radar-based sensors, infrared sensors, or any other system suitable for the purpose.

A distance, vehicle, and driver monitoring module 114 at each of the vehicles 102 through 108 receives signaling from the respective vehicle relative-position sensors 110 to calculate the respective distance 112 between the respective vehicle and other vehicles traveling in proximity to the respective vehicle. The distance, vehicle, and driver monitoring module 114 may also include global positioning system (GPS) tracking system modules for use in association with the vehicle relative-position sensors 110 to determine a location and/or position of the respective vehicle 102 through 108 relative to other vehicles within the vehicular environment.

The distance, vehicle, and driver monitoring module 114 also manages and monitors performance information associated with the vehicle, such as acceleration and deceleration (e.g., braking) capabilities, weight, wheel base, turning radius, cargo (e.g., fuel, gravel, etc.), and other data associated with the respective vehicle. Though the distance, vehicle, and driver monitoring module 114 is illustrated as a component-level module for ease of illustration and description purposes, it should be noted that the distance, vehicle, and driver monitoring module 114 may include multiple modules without departure from the scope of the present subject matter. Further, whether configured as a single module or as multiple modules, the distance, vehicle, and driver monitoring module 114 includes any hardware, programmed processor(s), and memory used to carry out the functions of the distance, vehicle, and driver monitoring module 114 as described above and in more detail below.

For example, the distance, vehicle, and driver monitoring module 114 may include additional controller circuitry in the form of application specific integrated circuits (ASICs), processors, antennas, and/or discrete integrated circuits and components for performing communication and electrical control activities associated with the distance, vehicle, and driver monitoring module 114. Additionally, the distance, vehicle, and driver monitoring module 114 also includes interrupt-level, stack-level, and application-level modules as appropriate. Furthermore, the distance, vehicle, and driver monitoring module 114 includes any memory components used for storage, execution, and data processing for performing processing activities associated with the distance, vehicle, and driver monitoring module 114. The distance, vehicle, and driver monitoring module 114 may also form a portion of other circuitry described without departure from the scope of the present subject matter.

Example processing performed by the distance, vehicle, and driver monitoring module 114 includes communicating with vehicles traveling in proximity to the vehicle within which the distance, vehicle, and driver monitoring module 114 operates; receiving vehicle identifiers, vehicle performance capabilities, location information (e.g., GPS coordinates), and driver orientation information from the vehicles; and determining vehicle spacing with respect to the other vehicles.

A communication module 116 is associated with each of the vehicles 102 through 108 to allow external communication between the vehicles 102 through 108 and with other modules within the system 100. The communication module 116 may form a portion of the distance, vehicle, and driver monitoring module 114 or modules or may be a separate module. Communication protocols used by the communication module 116 may include any suitable wireless communication protocol, such as a cellular protocol, a Bluetooth protocol, or other wireless protocol capable of allowing intercommunication between the vehicles 102 through 108 and between the vehicles 102 through 108 and other components within the system 100. For example, the communication module 116 may communicate with other vehicles in close proximity via the Bluetooth or other short-range protocol. Alternatively, the communication module 116 may communicate via a wireless network 118 with other devices and vehicles within the system 100.

A traffic monitoring device 120 monitors the vehicles 102 through 108. The traffic monitoring device 120 collects data associated with the vehicles 102 through 108. The traffic monitoring device 120 includes sensors (not shown), such as a camera, infrared sensor, GPS system, or other systems, to allow it to detect information associated with vehicle spatial relationships, relative speeds, and other information associated with the vehicles 102 through 108. Additionally, the traffic monitoring device 120 may determine weather conditions based upon the associated sensors and/or systems. Alternatively, the traffic monitoring device 120 may include a connection to a weather service (not shown) for determining current weather conditions.

Example processing performed by the traffic monitoring device includes communicating with vehicles within a given vehicular environment, receiving vehicle identifiers, vehicle performance capabilities, location information (e.g., GPS coordinates), and driver orientation information from the vehicles; and determining vehicle spacing with respect to the other vehicles. Additional example processing includes capturing image information for vehicles within a given vehicular environment, processing the captured image information, determining vehicle location information within the vehicular environment based upon the processed image information.

A traffic signaling module 122 provides traffic regulation and control signals for the vehicles 102 through 108 within a given vehicular environment. As such, for purposes of the present description, the traffic signaling module 122 may be considered a traffic regulation system. The traffic signaling module 122 may include any visual signaling module that provides visual signaling at an intersection on a roadway, at an airport, in association with a waterway or canal, or at a train station. Alternatively, the traffic signaling module 122 may include radio-frequency signaling capabilities to communicate the associated signaling to the vehicles 102 through 108 and other modules within the system 100. The traffic signaling module 122 may signal other modules within the system 100 contemporaneously with traffic signaling or in advance of signaling to allow flexibility within the system 100.

A traffic synchronization device 124 communicates via the wireless network 118 with each of the vehicles 102 through 108 via the respective communication module 116 and with other modules as described above and in more detail below in association with FIGS. 2 through 4. The traffic synchronization device 124 provides automated traffic synchronization, monitoring, and control within the system 100. The automated traffic synchronization, monitoring, and control is based upon spatial relationship information and performance information received either from the vehicles 102 through 108 or from the traffic monitoring device 120, traffic signaling information received from the traffic signaling device 122, and driver status information associated with drivers of the vehicles 102 through 108 received from the vehicles 102 through 108.

A database 126 is associated with the traffic synchronization device 124 and provides storage capabilities for information associated with the automated traffic synchronization, monitoring, and control performed by the traffic synchronization device 124. The database 126 includes a vehicle information storage area 128, a driver information storage area 130, and a traffic information storage area 132. Information and data stored within the vehicle information storage area 128, the driver information storage area 130, and the traffic information storage area 132 may be stored in the form of tables or other arrangements accessible by the traffic synchronization device 124.

The vehicle information storage area 128 stores vehicle information, such as spatial relationship information (e.g., GPS location information) and performance information, received from the vehicles 102 through 108 via the respective communication module 116. Additionally, the vehicle spatial relationship information may be received or determined from information received from the traffic monitoring device 120. The vehicle spatial information may include distances between vehicles within the given vehicular environment and may also include minimum desired spacing with respect to other vehicles for weather, speed, or other reasons. For example, a tanker truck full of gasoline or a dump truck full of gravel may have minimum desired spacing with respect to other vehicles, such as to stay a certain distance behind the vehicle, while traveling. The performance information includes acceleration and deceleration (e.g., braking) capabilities, weight, wheel base, turning radius, cargo (e.g., fuel, gravel, etc.), and other data associated with each of the vehicles 102 through 108.

The driver information storage area 130 stores driver status information associated with drivers of the vehicles 102 through 108 provided by the respective distance, vehicle, and driver monitoring module 114. The driver status information includes information such as driver body orientation information, driver head orientation information, driver eye direction information, and driver activity information.

The traffic information storage area 132 stores traffic information and data generated by the traffic monitoring device 120. As described above, the traffic information and data includes position information, spacing, relative speeds, and other information associated with the vehicles 102 through 108. Additionally, any determined traffic congestion patterns, such as rush hour patterns, may be stored to the traffic information storage area 132 for use during the automated traffic synchronization, monitoring, and control activities of the traffic synchronization device 124.

It should be noted that the traffic synchronization device 124 may be any computing device capable of processing information as described above and in more detail below. For example, the traffic synchronization device 124 may include devices such as a personal computer (e.g., desktop, laptop, palm, etc.) or a handheld device (e.g., cellular telephone, personal digital assistant (PDA), email device, music recording or playback device, etc.), or any other device capable of processing information as described.

Figure 2:
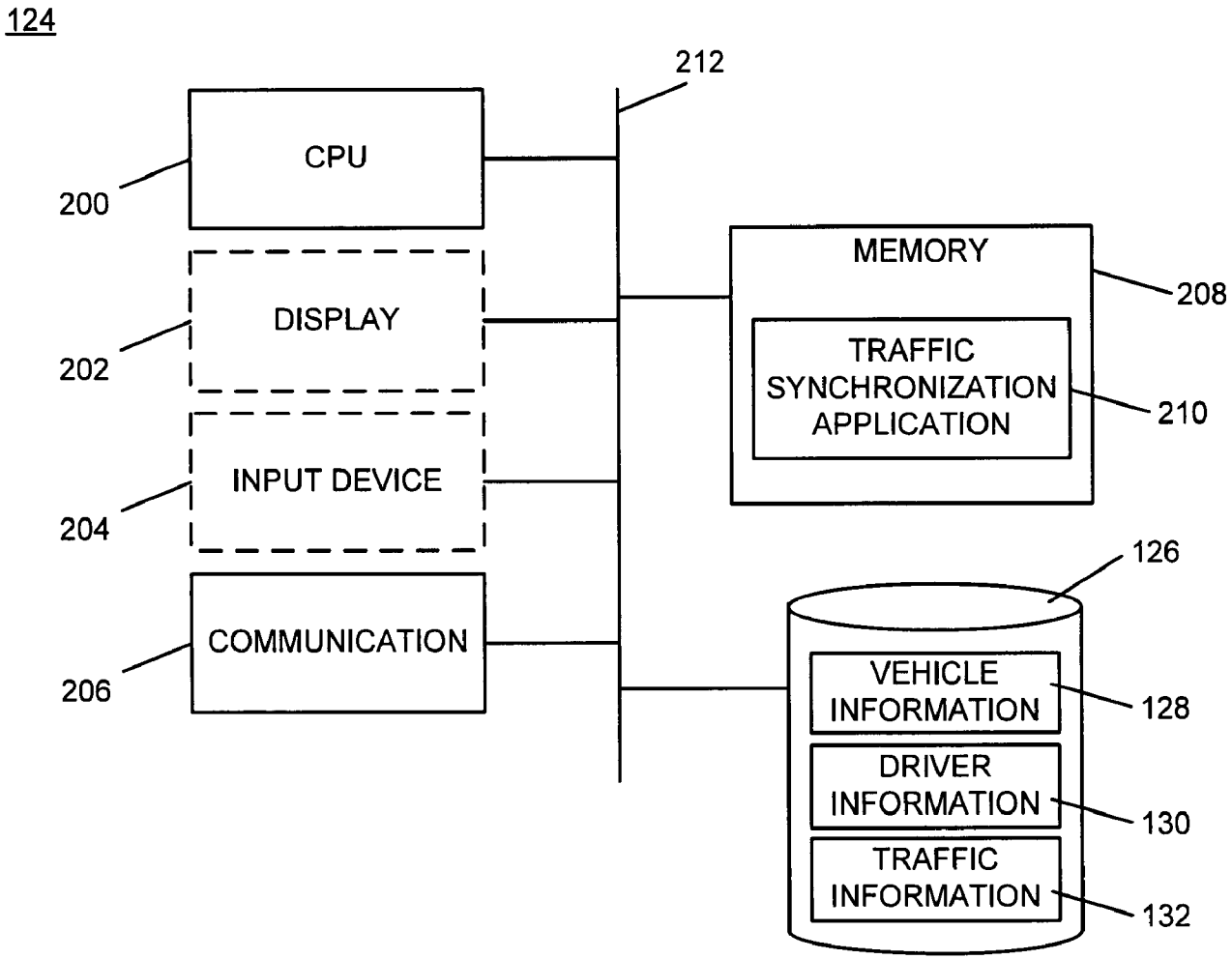
FIG. 2 is a block diagram of an example of an implementation of a traffic synchronization device that is capable of performing automated traffic synchronization, monitoring, and control based upon vehicle spatial relationship and performance information, traffic signaling information, and driver orientation information according to an embodiment of the present subject matter.

FIG. 2 is a block diagram of an example of an implementation of the traffic synchronization device 124 that is capable of performing automated traffic synchronization, monitoring, and control based upon vehicle spatial relationship and performance information, traffic signaling information, and driver orientation information. A central processing unit (CPU) 200 provides computer instruction execution, computation, and other capabilities within the traffic synchronization device 124. A display 202 provides visual information to a user of the traffic synchronization device 124 and an input device 204 provides input capabilities for the user.

The display 202 may include any display device, such as a cathode ray tube (CRT), liquid crystal display (LCD), light emitting diode (LED), projection, touchscreen, or other display element or panel. The input device 204 may include a computer keyboard, a keypad, a mouse, a pen, a joystick, or any other type of input device by which the user may interact with and respond to information on the display 202. The display 202 and the input device 204 provide user configurability and feedback for operations associated with the traffic synchronization device 124. For example, the display 202 may present status associated with the traffic synchronization device 124 to an administrative person associated with the traffic synchronization device 124. Additionally, the input device 204 may provide input capabilities for the traffic synchronization device 124, such as enabling and disabling functionality, status information, or configuration options.

It should be noted that the display 202 and the input device 204 are illustrated with a dashed-line representation within FIG. 2 to indicate that they are not required components for the traffic synchronization device 124. Accordingly, the traffic synchronization device 124 may operate as a completely automated embedded device or server-based without user configurability or feedback. However, the traffic synchronization device 124 may also provide user feedback and configurability via the display 202 and the input device 204, respectively.

A communication module 206 provides interconnection capabilities that allow the traffic synchronization device 124 to communicate with other modules within the system 100, such as any of the communication modules 116 of the vehicles 102 through 108, the traffic monitoring device 120, and the traffic signaling device 122. The communication module 206 may include any electrical, protocol, and protocol conversion capabilities useable to provide the interconnection capabilities. Though the communication module 206 is illustrated as a component-level module for ease of illustration and description purposes, it should be noted that the communication module 206 includes any hardware, programmed processor(s), and memory used to carry out the functions of the communication module 206 as described above and in more detail below.

For example, the communication module 206 may include additional controller circuitry in the form of application specific integrated circuits (ASICs), processors, antennas, and/or discrete integrated circuits and components for performing communication and electrical control activities associated with the communication module 206. Additionally, the communication module 206 also includes interrupt-level, stack-level, and application-level modules as appropriate. Furthermore, the communication module 206 includes any memory components used for storage, execution, and data processing for performing processing activities associated with the communication module 206. The communication module 206 may also form a portion of other circuitry described without departure from the scope of the present subject matter.

A memory 208 includes a traffic synchronization application 210 that provides the automated traffic synchronization, monitoring, and control for the traffic synchronization device 124, as described above and in more detail below. The traffic synchronization application 210 includes instructions executable by the CPU 200 for performing these functions. The CPU 200 executes these instructions to provide the processing capabilities described above and in more detail below for the traffic synchronization device 124.

The traffic synchronization application 210 may form a portion of an interrupt service routine (ISR), a portion of an operating system, a portion of a browser application, or a portion of a separate application without departure from the scope of the present subject matter. The traffic synchronization application 210 also calculates a synchronized control action for each of the vehicles 102 through 108 for synchronizing traffic with a traffic regulation system, such as the traffic signaling device 122, based upon traffic signaling information, and spatial relationship information and performance information for each of the vehicles 102 through 108.

Alternatively, as with other modules described, the traffic synchronization application 210 may be configured as a separate hardware or hardware/software module and may include additional controller circuitry in the form of application specific integrated circuits (ASICs), processors, antennas, and/or discrete integrated circuits and components for performing communication and electrical control activities associated with the traffic synchronization application 210. Additionally, the traffic synchronization application 210 may include any interrupt-level, stack-level, and application-level modules as appropriate. Furthermore, the traffic synchronization application 210 may include any memory components used for storage, execution, and data processing for performing processing activities associated with the traffic synchronization application 210. The traffic synchronization application 210 may also form a portion of other circuitry described without departure from the scope of the present subject matter.

It is understood that the memory 208 may include any combination of volatile and non-volatile memory suitable for the intended purpose, distributed or localized as appropriate, and may include other memory segments not illustrated within the present example for ease of illustration purposes. For example, the memory 208 may include a code storage area, a code execution area, and a data area without departure from the scope of the present subject matter.

The CPU 200, the display 202, the input device 204, the communication module 206, the memory 208, and the database 126 are interconnected via an interconnection 212. The interconnection 212 may include a system bus, a network, or any other interconnection capable of providing the respective components with suitable interconnection for the respective purpose.

It should be noted that the traffic synchronization device 124 is described as a stationary device for ease of illustration purposes. However, it should be noted that the traffic synchronization device 124 may be a portable device that may be carried by a user or may be a stationary device located within a moving vehicle, such as a plane, boat, train, automobile, or other vehicle, without departure from the scope of the present subject matter. In addition, components of the traffic synchronization device 124 may be co-located or distributed and interconnected via a network without departure from the scope of the present subject matter. It should also be understood that, though the vehicle information storage area 128, the driver information storage area 130, and the traffic information storage area 132 are shown within the database 126, they may also be stored within the memory 208 without departure from the scope of the present subject matter.

Accordingly, the traffic synchronization device 124 may take many forms and may be associated with many platforms. FIG. 3 and FIG. 4 below describe example processes that may be executed by the traffic synchronization device 124 and/or the traffic synchronization application 210 executed by the CPU 200 to perform the automated traffic synchronization, monitoring, and control activities.

Figure 3:
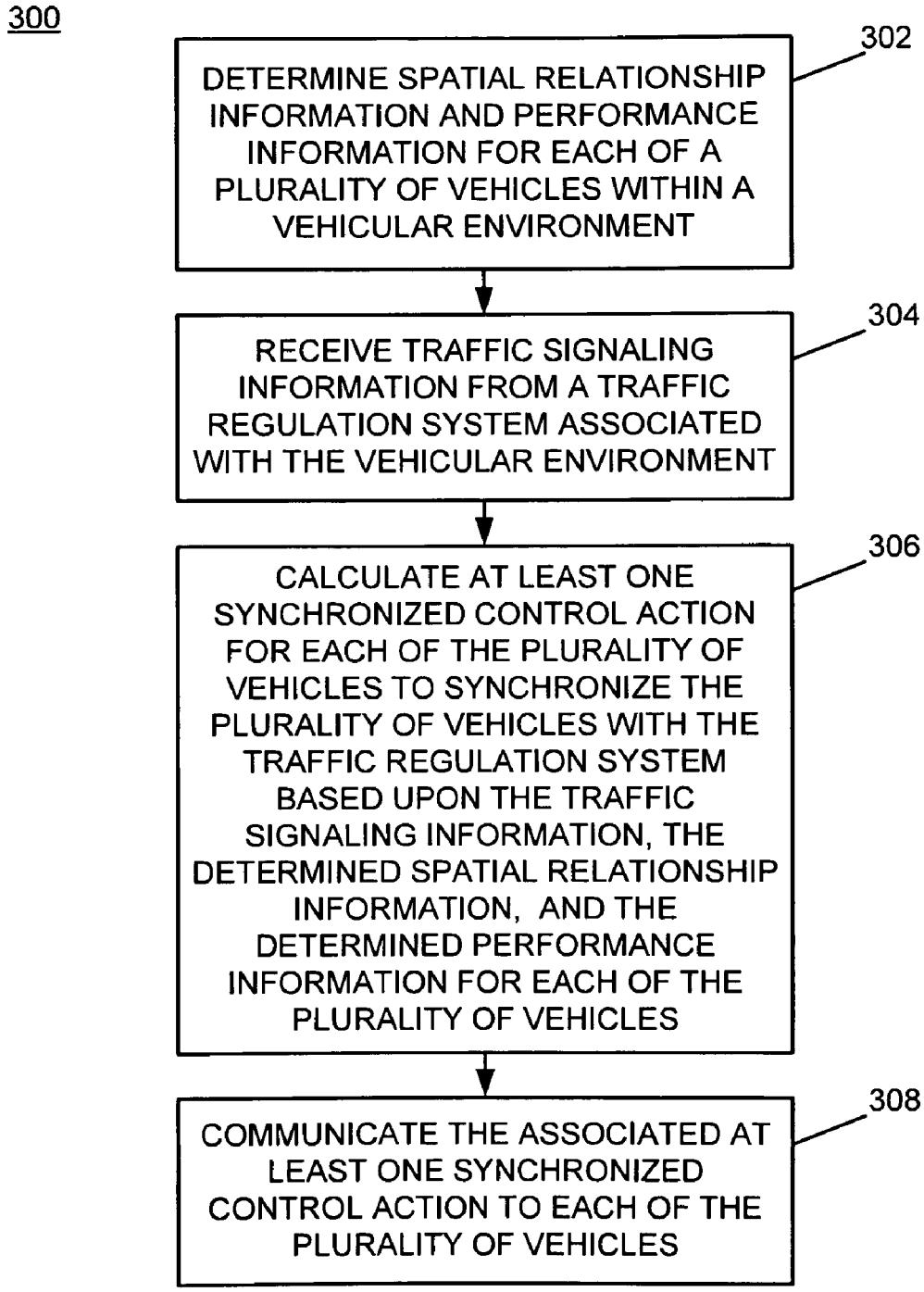
FIG. 3 is a flow chart of an example of an implementation of a process that automatically performs traffic synchronization, monitoring, and control based upon vehicle spatial relationship and performance information, and traffic signaling information according to an embodiment of the present subject matter.

FIG. 3 is a flow chart of an example of an implementation of a process 300 that automatically performs traffic synchronization, monitoring, and control based upon vehicle spatial relationship and performance information, and traffic signaling information. At block 302, the process 300 determines spatial relationship information and performance information for each of a plurality of vehicles within a vehicular environment. At block 304, the process 300 receives traffic signaling information from a traffic regulation system associated with the vehicular environment. At block 306, the process 300 calculates at least one synchronized control action for each of the plurality of vehicles to synchronize the plurality of vehicles with the traffic regulation system based upon the traffic signaling information, the determined spatial relationship information, and the determined performance information for each of the plurality of vehicles. At block 308, the process 300 communicates the associated at least one synchronized control action to each of the plurality of vehicles.

Figure 4:
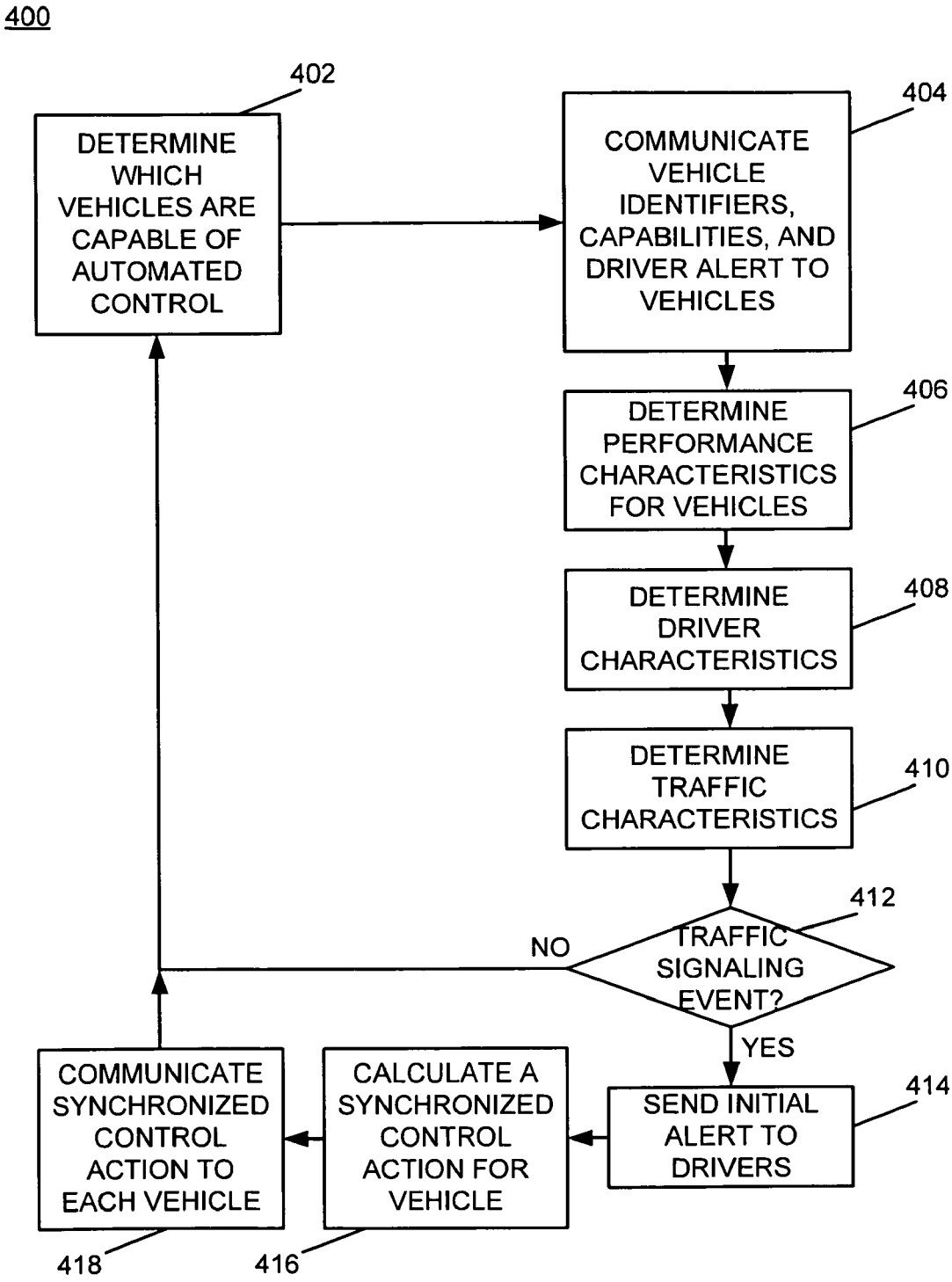
FIG. 4 is a flow chart of an example of an implementation of a process that automatically performs traffic synchronization, monitoring, and control based upon vehicle spatial relationship and performance information, traffic signaling information, and driver orientation information according to an embodiment of the present subject matter.

FIG. 4 is a flow chart of an example of an implementation of a process 400 that automatically performs traffic synchronization, monitoring, and control based upon vehicle spatial relationship and performance information, traffic signaling information, and driver orientation information. It should be noted that time out procedures and other error control procedures, as well as certain query and response activities, are not illustrated within the example process 400 for ease of illustration purposes. However, it is understood that all such procedures and activities are considered within the scope of the present subject matter.

At block 402, the process 400 determines which vehicles within a given vehicular environment are capable of automated control. As described above, certain vehicles within the vehicular environment may be capable of automated control based upon the automated traffic synchronization performed by the traffic synchronization device 124 and certain other vehicles may be controlled manually by a driver/operator of the vehicle. Accordingly, the process 400 makes the determination at block 402 to allow appropriate synchronization activities, as described in more detail below, to be performed. The determination made at block 402 may also include determining a vehicle identifier associated with each vehicle to allow automated control signaling to be communicated to each vehicle using the respective vehicle identifier.

The determination made by the process 400 at block 402 may include communication with the respective distance, vehicle, and driver monitoring module 114 or appropriate sub-module to poll or query each of the vehicles 102 through 108 within the vehicular environment for automated control capabilities. The polled inquiry or query may be communicated to the respective distance, vehicle, and driver monitoring module 114 or appropriate sub-module, as appropriate. Additionally, the determination made at block 402 may include receiving responses to the polled inquiries or queries of each of the vehicles 102 through 108. Further, the determination made at block 402 may be made in response to a broadcast of automated control capabilities produced by the distance, vehicle, and driver monitoring module 114 located within each of the vehicles 102 through 108 and received by the traffic synchronization device 124. Any broadcast capabilities of the distance, vehicle, and driver monitoring module 114 may be configured to be periodic or may be triggered upon entry into range of a given vehicular environment or traffic regulation device, such as the traffic signaling device 122. Many other possibilities exist for determining automated control capabilities of vehicles within a given vehicular environment and all are considered within the scope of the present subject matter.

At block 404, the process 400 communicates vehicle identifier information, vehicle capabilities (e.g., automated or non-automated), and a driver alert to vehicles within the given vehicular environment. This communication allows vehicles within the vehicular environment to become informed as to capabilities of surrounding vehicles. It should be noted that this portion of the process 400 may also be performed and/or verified by inter-vehicle communication via the communication modules 116 associated with each of the vehicles 102 through 108.

At block 406, the process 400 determines performance characteristics for the vehicles 102 through 108. The performance characteristics may include acceleration and deceleration (e.g., braking) capabilities, weight, wheel base, turning radius, cargo (e.g., fuel, gravel, etc.), and other data associated with the respective vehicles. At block 408, the process determines driver characteristics for drivers/operators of the vehicles 102 through 108. The driver characteristics may include driver body orientation information, driver head orientation information, driver eye direction information, and driver activity information, and other driver characteristics as described above.

As with other processing operations performed by the process 400, for both blocks 406 and 408, the process 400 may communicate with the respective distance, vehicle, and driver monitoring module 114 or appropriate sub-module to poll or query each vehicle within the vehicular environment for the respective performance and driver characteristics and may receive appropriate responses to the polled inquiries or queries of each of the vehicles 102 through 108. Further, the determination of the performance and driver characteristics may be made in response to broadcast performance and driver characteristics produced by the distance, vehicle, and driver monitoring module 114 located within each of the vehicles 102 through 108 and received by the traffic synchronization device 124. As described above, any broadcast capabilities of the distance, vehicle, and driver monitoring module 114 may be configured to be periodic or may be triggered upon entry into range of a given vehicular environment or traffic regulation device, such as the traffic signaling device 122. Many other possibilities exist for determining performance characteristics and driver characteristics and all are considered within the scope of the present subject matter.

At block 410, the process 400 determines traffic characteristics associated with the vehicles 102 through 108 within the respective vehicular environment. The traffic characteristics may include a number of vehicles, spacing, speed, and other characteristics. As described above, these characteristics may be received from the respective distance, vehicle, and driver monitoring module 114 or from the traffic monitoring device 124 in any manner described above for other processing operations performed by the process 400. The traffic characteristics may include GPS coordinates for each of the vehicles 102 through 108.

At decision point 412, the process 400 makes a determination as to whether a traffic signaling event has occurred. As described above, traffic signaling events may be generated by the traffic signaling device 122 and communicated to the traffic synchronization device 124 in any manner described above for other processing operations performed by the process 400. When a determination is made at decision point 412 that a traffic signaling event has not occurred, the process 400 returns to block 402 to iterate as described above through blocks 402 through 410 to continually and/or periodically monitor and update all tracked information. As such, the process 400 may remain in a ready state to perform automated traffic synchronization and control processing.

When a determination is made at decision point 412 that a traffic signaling event has occurred or is about to occur, depending upon configuration of the traffic signaling device 122 and its signaling configuration, the process 400 sends an initial alert to drivers of the vehicles 102 through 108 at block 414. The alert sent at block 414 notifies the drivers of the vehicles 102 through 108 that either an automated synchronization and control action is about to be performed for automated control vehicles or that an instruction for manual control will be provided to the driver of any non-automated vehicles.

At block 416, the process 400 calculates a synchronized control action for each of the vehicles 102 through 108. The synchronized control action may be an automated control action or a control action to be performed by the driver of the respective vehicle, such as acceleration and deceleration (e.g., braking) controls, a driver notification time, a vehicle start, and a vehicle stop time for each of the vehicles 102 through 108, as described above. At block 418, the process 400 communicates the respective synchronized control action to each vehicle within the given vehicular environment. The process 400 returns to block 402 to begin monitoring and data gathering activities as described above.

It should be noted that while the example of FIG. 4 is described with respect to communication with all vehicles within a vehicular environment, this should not be considered limiting as vehicles that are not capable of communication within the system 100 may still travel in association with vehicles that are capable of operation as described above. For example, if any vehicles are identified by the traffic monitoring device 122 and the traffic synchronization device 124 is unable to communicate with the respective vehicle, other vehicles may be notified and the respective drivers alerted that the identified vehicle is not participating in synchronization activities.

As described above in association with FIGS. 1 through 4, the example systems and processes provide automated traffic synchronization, monitoring, and control to coordinate and improve vehicular traffic patterns, safety, fuel consumption, time efficiency, facility use, and other traffic-related aspects in a variety of vehicular environments. The automated traffic synchronization, monitoring, and control is based upon a spatial relationship and performance information associated, traffic signaling information, and driver orientation information. The automated traffic synchronization, monitoring, and control described is applicable to roadways with congested traffic, stop lights, waterways and canals, airports, train stations or switching yards, and other vehicular environments. Many other variations and additional activities associated with automated traffic synchronization, monitoring, and control are possible and all are considered within the scope of the present subject matter.

Those skilled in the art will recognize, upon consideration of the above teachings, that certain of the above exemplary embodiments are based upon use of a programmed, processor such as CPU 200. However, the invention is not limited to such exemplary embodiments, since other embodiments could be implemented using hardware component equivalents such as special purpose hardware and/or dedicated processors. Similarly, general purpose computers, microprocessor based computers, micro-controllers, optical computers, analog computers, dedicated processors, application specific circuits and/or dedicated hard wired logic may be used to construct alternative equivalent embodiments.

As will be appreciated by one skilled in the art, the present invention may be embodied as a system, method or computer program product. Accordingly, the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, the present invention may take the form of a computer program product embodied in any tangible medium of expression having computer-usable program code embodied in the medium.

Any combination of one or more computer usable or computer readable medium(s) may be utilized. The computer-usable or computer-readable medium may be, for example but not limited to, an electronic, magnetic, optical, electromagnetic, infrared, or semiconductor system, apparatus, device, or propagation medium. More specific examples (a non-exhaustive list) of the computer-readable medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a transmission media such as those supporting the Internet or an intranet, or a magnetic storage device. Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory. In the context of this document, a computer-usable or computer-readable medium may be any medium that can contain, store, communicate, propagate, or transport the program for use by or in connection with the instruction execution system, apparatus, or device. The computer-usable medium may include a propagated data signal with the computer-usable program code embodied therewith, either in baseband or as part of a carrier wave. The computer usable program code may be transmitted using any appropriate medium, including but not limited to wireless, wireline, optical fiber cable, RF, etc.

Computer program code for carrying out operations of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a standalone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

The present invention has been described with reference to flowchart illustrations and/or block diagrams of methods, apparatus (systems) and computer program products according to example embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer-readable medium that can direct a computer or other programmable data processing apparatus to function in a particular manner, such that the instructions stored in the computer-readable medium produce an article of manufacture including instruction means which implement the function/act specified in the flowchart and/or block diagram block or blocks.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide processes for implementing the functions/acts specified in the flowchart and/or block diagram block or blocks.

The flowchart and block diagrams in the Figures illustrate the architecture, functionality, and operation of possible example implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

A data processing system suitable for storing and/or executing program code will include at least one processor coupled directly or indirectly to memory elements through a system bus. The memory elements can include local memory employed during actual execution of the program code, bulk storage, and cache memories which provide temporary storage of at least some program code in order to reduce the number of times code must be retrieved from bulk storage during execution.

Input/output or I/O devices (including but not limited to keyboards, displays, pointing devices, etc.) can be coupled to the system either directly or through intervening I/O controllers.

Network adapters may also be coupled to the system to enable the data processing system to become coupled to other data processing systems or remote printers or storage devices through intervening private or public networks. Modems, cable modems and Ethernet cards are just a few of the currently available types of network adapters.

Those skilled in the art will recognize improvements and modifications to the preferred embodiments of the present invention. All such improvements and modifications are considered within the scope of the concepts disclosed herein and the claims that follow.

What is claimed is:

1. A method, comprising:

determining spatial relationship information and vehicle performance capability information for each of a plurality of vehicles within a vehicular environment;

receiving traffic signaling change information from a traffic light signaling system indicating a traffic signal change at an intersection within the vehicular environment;

calculating at least one synchronized control action for each of the plurality of vehicles to synchronize the plurality of vehicles with the traffic light signaling system to stop or to start from a stop based upon the received traffic signaling change information, the determined spatial relationship information, and the determined vehicle performance capability information for each of the plurality of vehicles; and communicating the calculated at least one synchronized control action to each of the plurality of vehicles to indicate to each vehicle to stop or to start from the stop.

2. The method of claim 1, further comprising receiving driver status information for a driver of at least one of the plurality of vehicles from a driver monitoring module associated with the at least one of the plurality of vehicles, the driver status information comprising at least one of driver body orientation information, driver head orientation information, driver eye direction information, and driver activity information.

3. The method of claim 2, where calculating the at least one synchronized control action for each of the plurality of vehicles comprises calculating the at least one synchronized control action for each of the plurality of vehicles based upon the received driver status information.

4. The method of claim 1, further comprising receiving an indication from at least one of the plurality of vehicles that the at least one of the plurality of vehicles is capable of automated external control and where calculating the at least one synchronized control action for each of the plurality of vehicles comprises calculating at least one synchronized automated control action for automated control of the at least one of the plurality of vehicles.

5. The method of claim 1, further comprising receiving an indication from at least one of the plurality of vehicles that the at least one of the plurality of vehicles is not capable of automated external control and where calculating the at least one synchronized control action for each of the plurality of vehicles comprises calculating at least one synchronized manual control action for driver control of the at least one of the plurality of vehicles.

6. The method of claim 1, where the traffic signaling change information comprises one of an indication of a change from a red light to a green light and to start the plurality of vehicles from a stop, and an indication of a change from a green light to a yellow light and to initiate stopping the plurality of vehicles, and further comprising communicating a driver alert to at least one of the plurality of vehicles.

7. The method of claim 1, where calculating the at least one synchronized control action for each of the plurality of vehicles further comprises calculating an action time and at least one of an acceleration parameter to start from the stop, a deceleration parameter to initiate the stop, a driver notification time, a vehicle start time to start from the stop, and a vehicle stop time to stop for each of the plurality of vehicles.

8. The method of claim 1, where determining the spatial relationship information and the vehicle performance capability information for each of the plurality of vehicles comprises at least one of:

receiving the spatial relationship information from at least one of a driver monitoring module associated with each of the plurality of vehicles and a traffic monitoring module associated with the vehicular environment; and receiving the vehicle performance capability information from a vehicle monitoring module associated with each of the plurality of vehicles.

9. The method of claim 1, further comprising receiving weather information and compensating the calculated at least one synchronized control action based upon the received weather information.

10. The method of claim 1, where the plurality of vehicles further comprises at least one of a plurality of automobiles, a plurality of planes, a plurality of boats, and a plurality of trains.

11. A system, comprising:

a memory adapted to store traffic synchronizing information; and a processor programmed to:

determine spatial relationship information and vehicle performance capability information for each of a plurality of vehicles within a vehicular environment;

store the spatial relationship information and the vehicle performance capability information to the memory;

receive traffic signaling change information from a traffic light signaling system indicating a traffic signal change at an intersection within the vehicular environment;

store the traffic signaling change information to the memory;

calculate at least one synchronized control action for each of the plurality of vehicles to synchronize the plurality of vehicles with the traffic light signaling system to stop or to start from a stop based upon the received traffic signaling change information, the determined spatial relationship information, and the determined vehicle performance capability information for each of the plurality of vehicles; and communicate the calculated at least one synchronized control action to each of the plurality of vehicles to indicate to each vehicle to stop or to start from the stop.

12. The system of claim 11, where the processor is further programmed to receive driver status information for a driver of at least one of the plurality of vehicles from a driver monitoring module associated with the at least one of the plurality of vehicles, the driver status information comprising at least one of driver body orientation information, driver head orientation information, driver eye direction information, and driver activity information; and store the driver status information to the memory.

13. The system of claim 12, where, in being programmed to calculate the at least one synchronized control action for each of the plurality of vehicles, the processor is programmed to calculate the at least one synchronized control action for each of the plurality of vehicles based upon the received driver status information.

14. The system of claim 11, where the processor is further programmed to receive an indication from at least one of the plurality of vehicles that the at least one of the plurality of vehicles is capable of automated external control and where, in being programmed to calculate the at least one synchronized control action for each of the plurality of vehicles, the processor is programmed to calculate at least one synchronized automated control action for automated control of the at least one of the plurality of vehicles.

15. The system of claim 11, where the processor is further programmed to receive an indication from at least one of the plurality of vehicles that the at least one of the plurality of vehicles is not capable of automated external control and where, in being programmed to calculate the at least one synchronized control action for each of the plurality of vehicles, the processor is programmed to calculate at least one synchronized manual control action for driver control of the at least one of the plurality of vehicles.

16. The system of claim 11, where the traffic signaling change information comprises one of an indication of a change from a red light to a green light and to start the plurality of vehicles from a stop, and an indication of a change from a green light to a yellow light and to initiate stopping the plurality of vehicles, and where the processor is further programmed to communicate a driver alert to at least one of the plurality of vehicles.

17. The system of claim 11, where, in being programmed to calculate the at least one synchronized control action for each of the plurality of vehicles, the processor is programmed to calculate an action time and at least one of an acceleration parameter to start from the stop, a deceleration parameter to initiate the stop, a driver notification time, a vehicle start time to start from the stop, and a vehicle stop time to stop for each of the plurality of vehicles.

18. The system of claim 11, where, in being programmed to determine the spatial relationship information and the vehicle performance capability information for each of the plurality of vehicles, the processor is programmed to at least one of:

receive the spatial relationship information from at least one of a driver monitoring module associated with each of the plurality of vehicles and a traffic monitoring module associated with the vehicular environment; and receive the vehicle performance capability information from a vehicle monitoring module associated with each of the plurality of vehicles.

19. The system of claim 11, where the processor is further programmed to receive weather information and compensate the calculated at least one synchronized control action based upon the received weather information.

20. A system comprising:

a memory adapted to store traffic synchronizing information; and a processor programmed to:

determine spatial relationship information and vehicle performance capability information for each of a plurality of vehicles within a vehicular environment;

store the spatial relationship information and the vehicle performance capability information to the memory;

receive traffic signaling change information from a traffic light signaling system indicating a traffic signal change at an intersection within the vehicular environment, where the traffic signaling change information comprises one of an indication of a change from a red light to a green light and to start the plurality of vehicles from a stop, and an indication of a change from a green light to a yellow light and to initiate stopping the plurality of vehicles;

store the traffic signaling change information to the memory;

receive driver status information for a driver of at least one of the plurality of vehicles from a driver monitoring module associated with the at least one of the plurality of vehicles, the driver status information comprising at least one of driver body orientation information, driver head orientation information, driver eye direction information, and driver activity information;

store the driver status information to the memory;

calculate at least one synchronized control action for each of the plurality of vehicles to synchronize the plurality of vehicles with the traffic light signaling system to stop or to start from a stop based upon the received traffic signaling change information, the determined spatial relationship information, the determined vehicle performance capability information for each of the plurality of vehicles, and the driver status information, where the at least one synchronized control action comprises at least one of an acceleration parameter to start from the stop, a deceleration parameter to initiate the stop, a driver notification time, a vehicle start time to start from the stop, and a vehicle stop time to stop for each of the plurality of vehicles; and communicate the calculated at least one synchronized control action to each of the plurality of vehicles to indicate to each vehicle to stop or to start from the stop.

* * * * *